US005444228A

United States Patent [19]

Gelus

[11] Patent Number: 5,444,228

[45] Date of Patent: Aug. 22, 1995

[54] FLAT, FLEXIBLE HEATING ELEMENT WITH INTEGRATED CONNECTOR

[75] Inventor: Dominique Gelus, Eyzin-Pinet, France

[73] Assignee: SEB S.A., Selongey, France

[21] Appl. No.: 67,835

[22] Filed: May 27, 1993

Related U.S. Application Data

[63] Continuation-in-part of Ser. No. 8,101, Jan. 25, 1993.

[30] Foreign Application Priority Data

May 27, 1992 [FR] France ..... 92 06679

[51] Int. Cl.[6] ..... H05B 3/34

[52] U.S. Cl. ..... 219/549; 219/541; 219/528; 219/543

[58] Field of Search ..... 219/528, 529, 548, 549, 219/543,541; 338/330, 331, 325, 254, 255

[56] References Cited

U.S. PATENT DOCUMENTS

| | | | |
|---|---|---|---|
| 791,691 | 6/1905 | Hadaway | 338/254 |
| 1,110,805 | 9/1914 | Loetscher | 219/548 |
| 3,283,284 | 11/1966 | Eisler | 338/330 |
| 3,794,809 | 2/1974 | Beck | 219/543 |
| 4,139,763 | 2/1979 | McMullan et al. | 219/528 |
| 4,860,434 | 8/1989 | Louison et al. . | |
| 4,933,534 | 6/1990 | Cunningham | 219/549 |
| 4,942,286 | 7/1990 | Monter | 219/549 |
| 4,952,783 | 8/1990 | Aufderheide | 219/528 |
| 4,995,177 | 2/1991 | Louison et al. . | |

FOREIGN PATENT DOCUMENTS

| | | |
|---|---|---|
| 1207365 | 7/1986 | Canada . |
| 0201967 | 11/1986 | European Pat. Off. . |
| 0331565 | 6/1989 | European Pat. Off. . |
| 0334824A3 | 9/1989 | European Pat. Off. . |
| 2048252 | 3/1971 | France . |
| 0127226 | 12/1984 | France . |
| 1299089 | 7/1969 | Germany . |
| 2615064 | 10/1977 | Germany . |
| 1545770 | 5/1979 | United Kingdom . |

*Primary Examiner*—Teresa J. Walberg
*Attorney, Agent, or Firm*—Spensley Horn Jubas & Lubitz

[57] ABSTRACT

A flexible heating element is composed of at least one resistive conductor circuit having a first pair of ends, two sheets of electrically insulating material enclosing the conductor circuit, and a member for connecting the conductor circuit to at least one exterior electric unit. The member for connecting is constututed by at least one flexible connection tongue forming a projecting portion of the heating element. Two connection strips are each conductively connected to a respective end of the conductor circuit and are dimensioned to have a resistance appropriate to their connection function.

22 Claims, 3 Drawing Sheets

FLAT, FLEXIBLE HEATING ELEMENT WITH INTEGRATED CONNECTOR

CROSS-REFERENCE TO RELATED APPLICATIONS

The present application is a continuation-in-part of my copending application Ser. No. 08/008,101, filed Jan. 25, 1993. The entire disclosure of that application is incorporated herein by reference.

BACKGROUND OF THE INVENTION

The present invention relates to the general technical field of flexible heating elements composed of a heating circuit and means for establishing electrical connection with an exterior energy source.

The present invention concerns, more particularly, a flexible heating element, which is preferably flat, composed of at least one resistive wire defining a heating circuit inserted between two electrically isolating films.

Such a heating element can be utilized in all technical fields requiring the heating of bodies, which may be solid, liquid, or even gaseous, and the heating element according to the invention is not limited to any specific field of use. Preferably, the heating element according to the invention is more particularly intended to be integrated in a home electric appliance, and the invention concerns, to this effect, any home electric appliance containing a heating element according to the invention, and more particularly cooking appliances such as boilers and pressing irons, particularly steam irons.

It is already known to produce flexible heating circuits composed of a resistive element obtained, for example, by etching of a metal conductor. A resistive element which, for example, is based on an alloy of copper, tin or aluminum, is inserted, for example by a heat treatment under pressure, between two sheets, or films, of an electrical insulating material. The electrical insulating material can be composed of, for example, polyester, silicone glass, or even micanite. The resulting heating element possesses a certain flexibility, is generally substantially flat and can have any possible geometric form, including circular, rectangular, etc, selected on the basis of the desired utilization and installation conditions. In a standard manner, such heating elements are integrated into a structure or an apparatus in order to supply thermal energy and are provided, for this purpose, with means for connection to an energy source.

Up to the present, the electrical connections have always consisted, regardless of the specific application, of a series of isolated flexible wires and/or an assembly of isolated rigid metal bars connecting the circuit of the resistive element to the electrical energy supply source or sources. In a standard manner, the connection between the connecting wires and the circuit bars is effected by soldering, brazing or welding, preferably with tin, of the wire to the resistive circuit. For certain applications, it is possible to use conductive cements or even other types of soldering or brazing material such as electricians solder.

On the industrial level, and in particular in the case of fabrication of electrical home appliances, the use of a connector based on cables, wires or bars of the type mentioned above, which it is necessary to install on the electric home appliances, is time consuming and delicate and which therefore represents a non-negligible cost. Thus, it is generally necessary to precut the wires to the desired length, insulate them and possibly furnish them with terminals or lugs, and then proceed to the connection with energy supply or regulating units, followed by the soldering itself. This series of operations is difficult to integrate into an industrial fabrication process, in particular for the fabrication of home electric appliances such as pressing irons.

SUMMARY OF THE INVENTION

Accordingly, it is an object of the present invention to ameliorate the various drawbacks and difficulties mentioned above.

Another object of the invention is to provide a flexible heating element which permits the elimination of all additional electrical connections on the heating element in order to facilitate the installation of these elements.

A further object of the invention is to furnish a flexible heating element to which different electrical units can be connected without the connection operation itself being rendered more complex.

Yet another object of the invention is to furnish a flexible heating element having connection means presenting a good moisture seal in order to be able to be integrated into a appliances, in particular, electric home appliances, intended to function under relatively high humidity conditions.

The above and other objects according to the invention are achieved by the provision of a flexible heating element comprising at least one resistive wire defining a circuit with at least one input strand and one output strand, said wire being inserted between two electrical isolation films and being connected to at least one exterior electric unit by connection means, wherein said connection means are constituted at least by a flexible connection tongue forming a prolongation of the heating element and comprising, between the two electrical insulating films, at least two connection strands coming from the circuit, connected to the electric unit and having a resistance adapted to their connection function.

Other particularities and advantages of the invention will become apparent from a reading of the following description, presented with reference to the attached drawings, given by way of non-limiting example.

DESCRIPTION OF THE PREFERRED EMBODIMENTS

Figure 1:
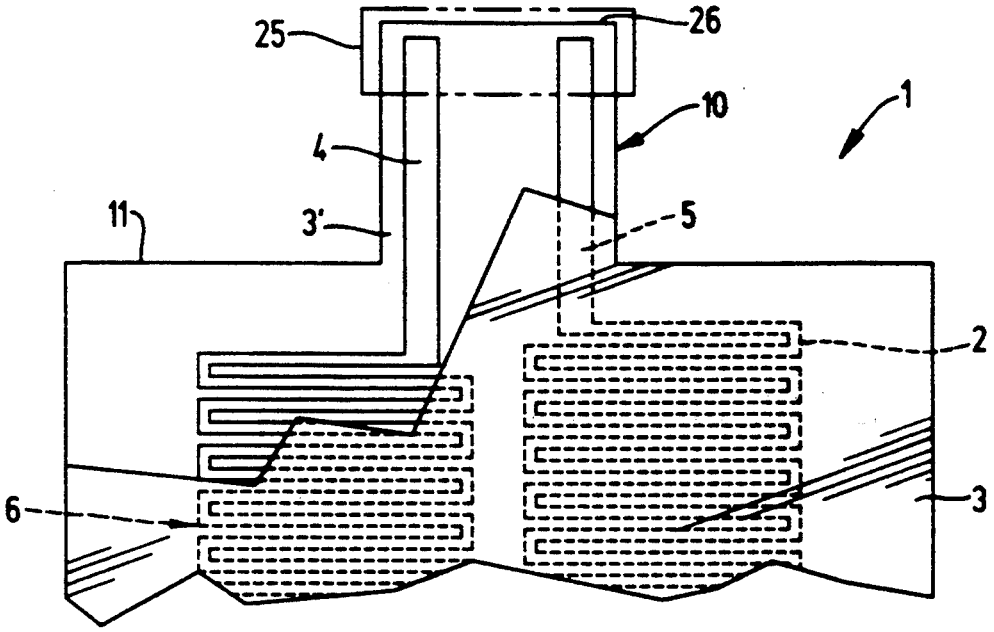
FIG. 1 is a top plan detail view of a portion of a heating element according to the invention including a connection tongue according to the invention.

Referring to FIG. 1, a heating element 1 according to the invention is constituted in a known manner of a resistive wire 2 of any suitable material such as copper, aluminum, brass, etc, inserted between two isolating sheets, or films, 3, 3'. In FIG. 1, sheet 3 is on top and sheet 3' is on the bottom. The relation between sheets 3 and 3' can further be seen in FIG. 5.

Figure 5:
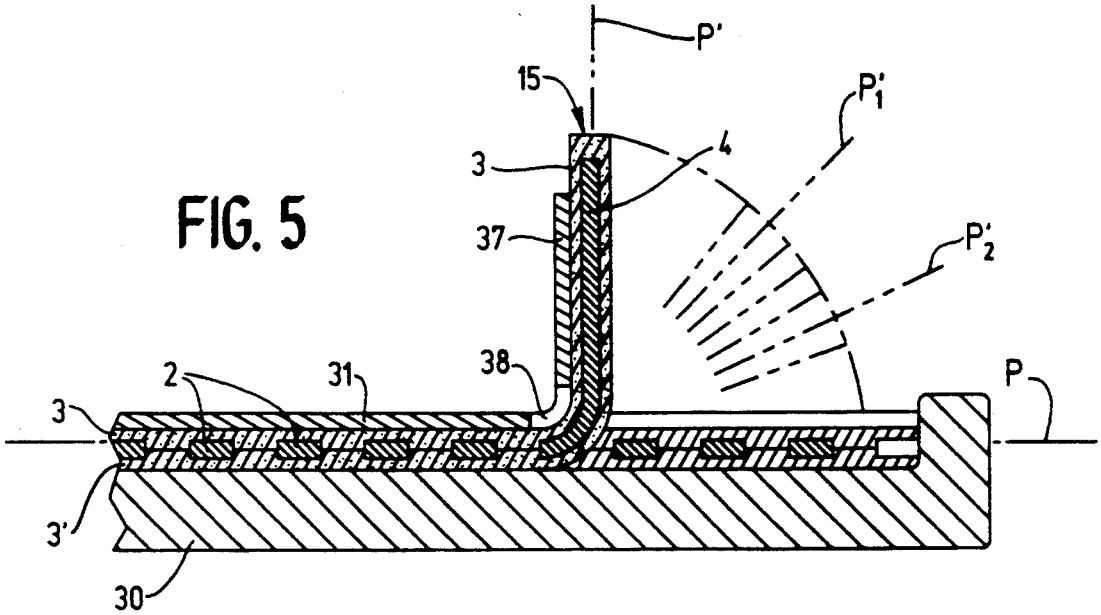
FIG. 5 is a cross-sectional detail view of a pressing iron sole plate provided with a connection tongue according to the invention and sealing means.

As is most apparent from FIG. 5, sheets 3 and 3' contact, and adhere to, one another in the regions between adjacent lengths of wire 2 and also adhere to wire 2. The composition of sheets 3 and 3' is selected on the basis of the desired use, from among materials represented by PVC, polyester, polyimide, silicone, etc. The thicknesses of layers 3 and 3' being minimal, heating element 1 is flexible and will generally extend across a single plane so that it can be considered to be flat.

According to the use envisioned, heating element 1 presents obviously a form adapted to the device in which it will be installed and resistive wire 2 defines a circuit equally adapted to the heat dissipation flux which it must furnish.

In the description to follow, heating element 1 to which reference will be made uniquely for purposes of explanation, has a geometric form characteristic of heating elements intended to be installed in the sole plate of a pressing iron. It is of course to be understood that the geometric form to which reference will be made is not limiting and that one skilled in the art can without difficulty alter that form to give the heating element a circular or rectangular form, for example, for purposes of integrating the heating element into another type of electric household appliance, such as a cooking appliance.

Heating element 1, such as that shown in FIG. 1, comprises a resistive conductor 2 delimiting, between an input strip or strand 4 and an output strip or strand 5, a resistive circuit 6. Circuit 6 is obtained, for example, by chemical cutting, or etching, or by silk screen printing and is advantageously composed of a series of loops forming a serpentine conductive path. Resistive conductor 2 is intended to be connected, when the heating element is for example installed in the sole plate of a pressing iron, to an exterior electric unit constituted in this case by a supply unit such as the local power means. The connection is effected, obviously, by the intermediary of a power cable intended to be plugged into the mains. To this end, heating element 1 comprises, as connecting means, a connection tongue 10 forming a prolongation of the structure of heating element 1 itself. Connection tongue 10 extends, in the example shown in FIG. 1, outside of the principal geometric envelope bounding the heating element, starting from the periphery of that envelope. In the embodiment shown in FIG. 1, tongue 10 extends from periphery 11 formed by the rear edge of heating element 1, constituting thus the attachment edge. In the embodiment shown in FIG. 1, connection tongue 10 thus forms an external tongue having a length which can be selected according to the distance of the necessary connections. Tongue 10 has, for example, a square or rectangular shape and is limited toward the outside by portions of insulating sheets 3 and 3'. Tongue 10 includes inlet strip 4 and outlet strip 5 of resistive circuit 2, strips 4 and 5 being inserted between insulating sheets 3 and 3'. In such a case, inlet and outlet strips 4 and 5 constitute principal connection strips for circuit 6 and are intended to connected to an electric unit, in this case a power supply unit. For this purpose, connection strips 4 and 5 are given a resistance adapted to their connection function, produced for example by giving strips 4 and 5 an appropriate width relative to the average width of the strip constituting the rest of circuit 6.

Connection tongue 10 presents the same internal structure as the rest of heating element 1 and, as a result, has the flexibility necessary to be able to be movable and to be folded out of, and starting from, the principal extension plane of heating element one connection tongue 10 can thus be plugged directly into an appropriate electrical unit, by simple bending, or folding, about a folding line extending along rear edge 11, then by multidirectional deformation according to the desired direction of the connection, which may be a plug connection.

Figure 2:
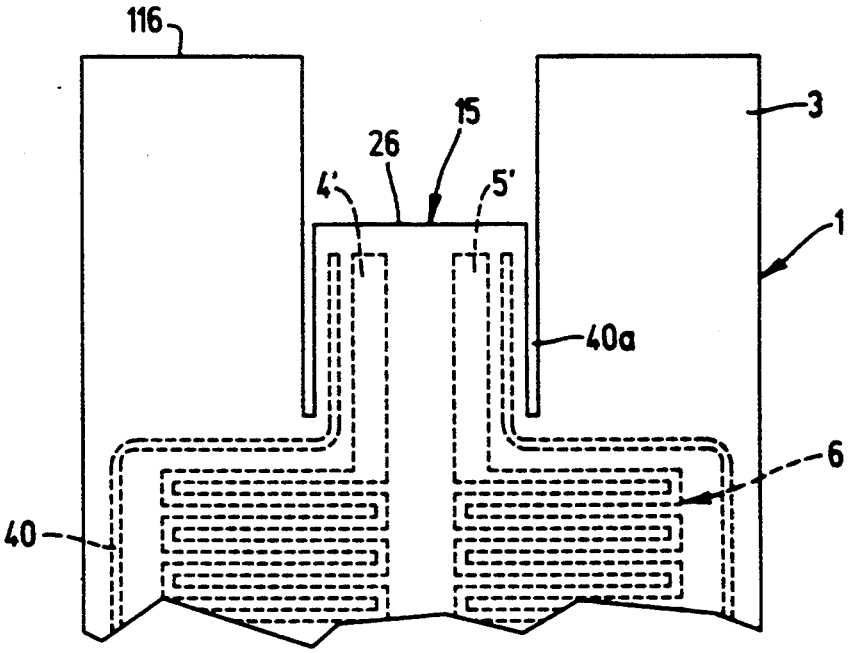
FIG. 2 is a view similar to that of FIG. 1 of another embodiment of the connection tongue according to the invention.

The embodiment of a heating element 1 shown in FIG. 2 differs from that shown in FIG. 1 only by the particular arrangement of the connection means which in the embodiment of FIG. 2 are constituted by an internal, or recessed, connection tongue 15. Tongue 15 is located at least partially within the interior of the geometric envelope delimiting heating element 1. In the embodiment shown in FIG. 2, connection tongue 15 is located totally within that envelope. According to the embodiment of FIG. 2, connection tongue 15 is thus created in a cutout, or recess, extending inwardly from the geometric envelope delimiting heating element 1, the recess preferably extending in from the rear edge **11*b*. In the same manner as for the embodiment of FIG. 1, internal tongue 15 possesses a structure corresponding to that of the totality of the heating element and is provided with connection strips 4' and 5' ending within tongue 15**.

Figure 3:
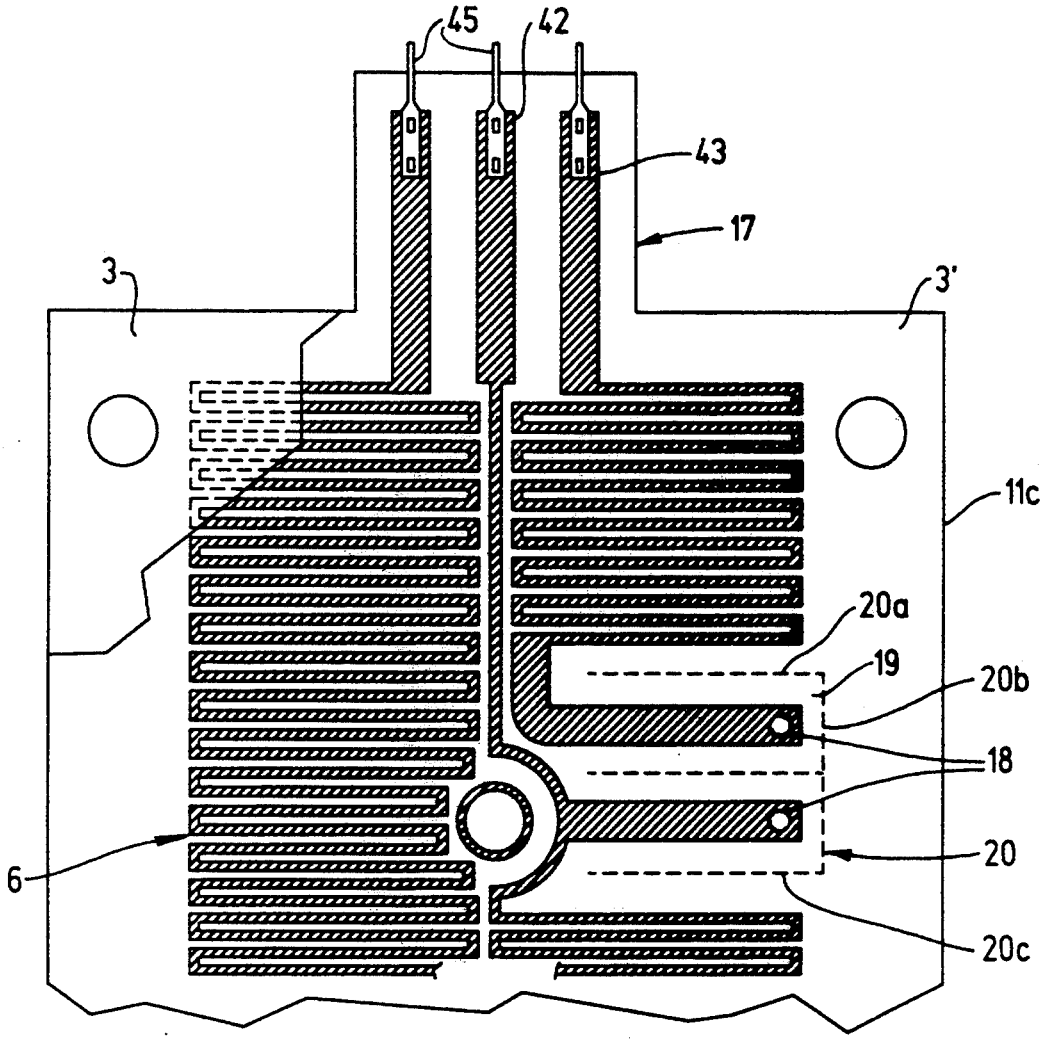
FIG. 3 is a view similar to that of FIG. 1, in greater detail, showing a heating element according to the invention having several connection tongues.

As shown in FIG. 3, a heating element according to the invention can include, in addition to an external connection tongue 17 intended to be connected to the local power mains, at least one other pair of connection strips forming secondary connection strips 18 integrated into circuit 6 and projecting therefrom. Secondary connecting strips 18 can be formed in connection tongues similar to external tongue 10 or internal tongue 15, like those shown in FIGS. 1 and 2. In the embodiment shown in FIG. 3, secondary connection strips 18 are formed within an internal tongue 19 created by partially cutting through insulating films 3 and 3' around secondary connection strips 18.

A cutting line 20 surrounds, and is spaced from, secondary connection strips 18, except for an attachment edge opposite to the outer ends of strips 18, the attachment edge forming a connection region with the remainder of heating element 1. The cutting lines can be formed of three lines **20*a*, 20*b* and 20*c* which are completely precut, or can consist of elongated perforations along the same lines 20*a*, *b* and *c* constituting starting lines along which internal tongue 19 can be broken away from the remainder of the heating element at the time of installation or when a connection is to be made to strips 18. In particular, tongue 19 can be broken away along lines 20** and bent upwardly or downwardly from the plane of the heating element.

Line **20*b* which delimits the edge of tongue 19 which is substantially perpendicular to the longitudinal axes of secondary strips 18 extends at a distance from an adjacent periphery 11*c* of the heating element. Tongue 19 is thus completely within the outline of the heating element. In heating elements of the type shown in FIG. 3, resistive circuit 6 can be composed of several pairs or series of secondary connecting strips 18 and, consequently, can comprise several series of internal and/or external connection tongues distributed around the heating circuit. Connection tongues of internal or external type are intended to be connected by their associated strips 18** to various electric units connected in the electric appliance in which the heating element is installed. These electric units can be, for example, indicator lights, thermostats, electronic regulation circuits such as ICs, etc.

For certain uses, and particularly when heating elements according to the invention are installed in electrical household appliances, such as pressing irons, it is important that the connection tongues 10, 15, 17 be constructed to provide a good moisture seal for circuit 6 and all of the connection strips. In effect, electrical household appliances of the type mentioned above are likely to function in the presence of steam or moisture which should be maintained out of contact with connection strips 4, 5, 18, etc. For this purpose, it is proposed to dispose along the peripheries of tongues 10, 15, 17 and 20 appropriate moisture sealing means. These means can consist of the simple affixing, by cementing for example, of a ribbon 25 (FIG. 1) which straddles the two insulating films 3 and 3' and extends at least over the outer end 26 of tongue 10. Ribbon 25 can be made of a material selected to present good moisture isolation properties.

Figure 4:
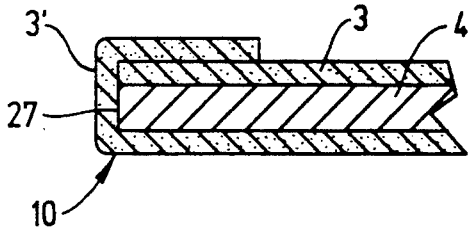
FIG. 4 is a cross-sectional detail view of a connection tongue according to the invention provided with sealing means.

The sealing means can equally be constituted, as shown in FIG. 4, by folding over the lower insulating film 3' upon upper insulating film 3. Film 3' overlaps film 3 for a distance sufficient to close the external edge 27 of tongue 10. Conversely, upper insulating film 3 can have a length greater than that of lower film 3' and upper film 3 can then be folded over onto lower film 3'. In these forms of construction, connection strips 4 and 5, which end adjacent outer edge 27 are protected against all penetration by moisture.

Figure 6:
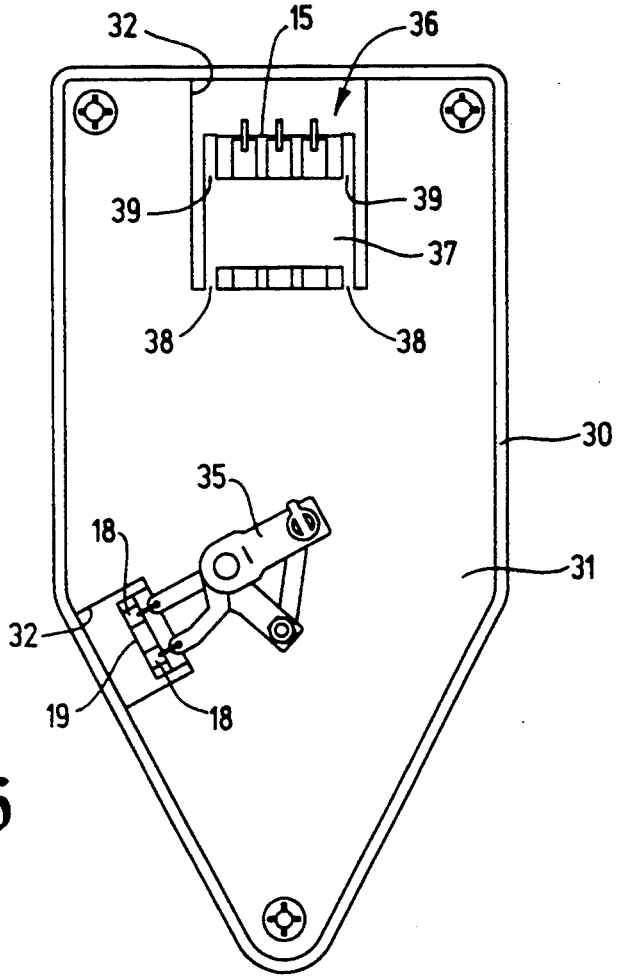
FIG. 6 is a top plan view of a pressing iron sole plate provided with the heating element shown in FIG. 3.

FIGS. 5 and 6 show two views of a sole plate of a pressing iron, the sole plate including a lower metal plate 30 which constitutes a pressing surface and forms a heat emitting plate, upon which is fixed an upper retaining plate 31. Heating element 1 according to the invention is maintained in placed by compression and cementing between plates 30 and 31. Retaining plate 31 is provided with a series of notches 32 arranged in alignment with connection tongues 10, 15, or 17, in a manner to form openings for the passage of such connection tongues. The electric units of the pressing iron which must be connected to resistive circuit 6 being situated at a level above the plane of plate 31, it is thus possible to displace by bending connection tongues 10, 15, or 17 within notches 32. In FIG. 6, one notch 32 is arranged to permit raising of connection tongue 19 to permit coupling of secondary attachment strips 18 to terminals of a thermostat 35.

The totality of the rear connector 36 (FIGS. 5 and 6) includes an internal tongue 15 adhering via its upper face, formed by the electrical insulating film 3 on a movable plate, or flap, 37 created from the partial or total cutting of one of the notches 32. Preferably, movable flap 37 is constituted by a part of retaining plate 31, formed by cutting plate 31 in a manner to cause flap 37 to be connected to the remainder of plate 31 by one or preferably two deformable connection strips 38 performing the function of hinges. In the example shown in FIG. 6, movable flap 37 has a form that resembles the letter H, defining, starting from connection strips 38, to exterior strips, or legs, 39.

In an advantageous manner, resistive circuit 6 can be surrounded completely or partially by a resistive strip 40 of inert material, as shown in FIG. 2. Strip 40 includes, for example, two lateral strip portions **40*a* extending along connection strips 4' and 5' (FIG. 2) or 18 (FIG. 3). Strip portions 40*a* like the remainder of inert strip 40 are obviously inserted between the two electrical insulating film sheets 3 and 3'. If necessary, resistive strip 40 of inert material can also completely surround resistive circuit 6 and can come to extend in parallel with, and at a distance from, edge 26 of tongue 10, 15, or 20. Lateral strip portions 40a are disposed in the connection tongue 10, 15, or 20 in such a manner that legs 39 of movable flap 37 totally cover strip portions 40*a*. Thus, at the time of fabrication of a heating element according to the invention, each insulating film 3, 3' composed of a layer of cement on each of its two opposed faces, fabrication of the heating structure can be effected by pressing together the two plates 30 and 31, with insulating films 3 and 3' having been preliminarily cemented and positioned directly between plates 30 and 31. The cementing, or bonding, operation is simplified and sealing of the heating element, particularly against moisture, is particularly improved in the region of connecting strips 4 and 5. In effect, the presence of movable flap 37 permits a cementing, or bonding, over the totality of the surface of film 3 of the heating element, which represents a non-negligible simplification of the bonding process itself on the one hand and permits during application of the retaining plate 31 a pressing and a cementing of connection tongue 15 against the central surface and legs 39 of flap 37, on the other hand. The exterior surface of the tongue 10, 15, or 19, formed by a portion of film 3', is not cemented or is provided with a supplemental film preventing its adhesion to plate 30. Overall sealing of tongue 15 is thus assured, on the one hand by the compression of strip portions 40*a* by legs 39 and on the other hand by the compression of insulating films 3 and 3' against one another and against attachment strips 4 and 5**.

As shown in FIG. 5, for example, movable flap 37 can be lifted, starting from the plane P in which it initially extends parallel to the plane of the sole plate, in order to be placed in a connection position in which it lies in a plane P' which extends substantially perpendicular to plane P. Tongue 15 can thus be lifted to occupy any intermediate position, such as $P'_1$ or $P'_2$, by a pivoting of mobile flap 37 around an axis passing through the two connection arms 38 and lying in the plane P. It is to be noted that as a result of the rigidity of plate 31, the selected orientation into which tongue 15 is moved will be stable. The number of connection strips thus inserted between the electrically isolating sheets 3 and 3' is not limited and, as shown in FIG. 3 for example, three connection strips 41, 42 and 43 can be provided in a single tongue 17.

After a heating element according to the invention has been installed in an electric appliance, the actual connection of connecting strips 4 and 5, or 18, or 41, 42 and 43 and the terminals of electric units can be effected in a variety of ways. Thus, it is possible to secure attachment strips 4 and 5, for example, to terminals of the electric appliance with the aid of screws extending through the thickness dimension of the attachment strips. Alternatively, it is possible to effect the connection by soldering or brazing. For this purpose, a small region of one of insulating films 3 and 3' would be removed to allow access to the underlying conductive strip 4, 5. In a particularly advantageous manner, it is possible to employ complimentary attachment means such as lugs 45, shown in FIG. 3, fixed directly through each of strips 41, 42 and 43. Lugs 45 are provided with fastening pins which also extend through the thickness of insulating sheets 3 and 31. Thus, lugs 45 may be secured to strips 41, 42 and 43 in the manner of staples.

An electric assembly comprising a heating element according to the invention thus does not require any connection wires, cables or bars for connecting the heating structure with different electric units of the appliance. In effect, due to the flexible connection tongues which freely extend the heating structure and the resistive circuit in the form of flat tabs, it is possible to fold any one of the tongues in order to conform it to the available space and to place it in the desired relation with attachment terminals, while causing the connection tongues to perform a function equivalent to that of a connection wire. Assembly of an appliance itself is thus greatly simplified. In addition, in the specific uses relative to home electric appliances likely to be in the presence of moisture, the use of a sealing means, such as movable flaps 37, permits a connection tongue to not only remain movable, but also to maintain a sealed covering for the connection strips.

This application relates to subject matter disclosed in French Application number 9206679, filed on May 27, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A flexible heating element comprising:

at least one resistive conductor circuit having a first pair of ends;

two sheets of electrically insulating material enclosing said conductor circuit;

and means for connecting said conductor circuit to at least one exterior electric unit, wherein said means for connecting are constituted by at least one flexible connection tongue forming a projecting portion of said heating element, and two connection strips disposed in said flexible connection tongue for connection to the electric unit, and wherein said connection strips are each conductively connected to a respective end of said first pair of ends and are dimensioned to have a resistance appropriate to their connection function.

2. A heating element as defined in claim 1 wherein said conductor and said sheets of electrically insulating material are delimited by a geometric envelope, and said means for connecting project outwardly from said envelope to form an external connection tongue.

3. A heating element as defined in claim 2 wherein said conductor circuit has a second pair of opposed ends, and said means for connecting further comprise a second flexible connection tongue forming a projecting portion of said heating element, and a second pair of connection strips disposed in said second connection tongue for connection to the electric unit, said second connection strips each being conductively connected to a respective end of said second pair of opposed ends and being dimensioned to have a resistance appropriate to their connection function, and said second flexible connection tongue being disposed within the geometric envelope and being connected to said conductor circuit at an attachment edge, whereby said second connection tongue forms an internal tongue.

4. A heating element as defined in claim 3 wherein said second flexible connection tongue is formed by partial cutting of said sheets of electrically insulating material around said second connection strips, said second connection tongue being entirely enclosed in said heating element.

5. A heating element as defined in claim 1 wherein said conductor and said sheets of electrically insulating material are delimited by a geometric envelope, and said flexible connection tongue is disposed within the geometric envelope to form an internal connection tongue.

6. A heating element as defined in claim 5 wherein said flexible connection tongue is formed by partial cutting of said sheets of electrically insulating material around said connection strips, said connection tongue being entirely enclosed in said heating element.

7. A heating element as defined in claim 1 wherein said two connection strips constitute respectively, an input conductor and an output conductor for one said conductor circuit.

8. A heating element as defined in claim 1 wherein said connection tongue has a periphery, and further comprising sealing means extending along said periphery of said connection tongue for preventing moisture from reaching said at least one resistive conductor circuit and said connection strips.

9. A heating element as defined in claim 8 wherein said connection strips have a free end disposed in proximity to an associated end of said flexible connection tongue, and said sealing means are constituted by a portion of one of said sheets of electrically insulating material folded over the other one of said sheets of electrically insulating material with a mutual overlap sufficient to seal said associated end of said tongue.

10. A heating element as defined in claim 1 wherein said connection tongue has two opposed edges one of which edges is connected to a portion of said heating element which is adjacent said connection tongue and the other of which edges is a free edge not connected to the remainder of said heating element, and further comprising sealing means comprising a strip of moisture sealing material extending along said free edge of said connection tongue for preventing moisture from reaching said connection strips.

11. A heating element as defined in claim 1 in combination with first and second metal plates, with each of said sheets of electrically insulating material being cemented to a respective one of said metal plates, wherein said first metal plate is a heat emitting plate and said second metal plate is a support plate having a portion which is adjacent said flexible connection tongue, said portion constituting a movable flap to which said flexible connection tongue adheres to retain said flexible connection tongue in a position in which said flexible connection tongue is bent relative to an adjacent portion of said flexible heating element.

12. A heating element as defined in claim 11 wherein said flap is a piece which is cut out from said second metal plate and which is joined to an adjacent portion of said second metal plate by at least one deformable connection arm forming a portion of said second metal plate.

13. A heating element as defined in claim 12 wherein said movable flap has the form of an H and includes two said deformable connection arms forming legs of the H, and said heating element further comprises a strip of chemically inert, electrically resistive material disposed in said connection tongue, between said sheets of electrically insulating material and adjacent said connection strips for providing a moisture seal for said connection strips, said strip being compressed by said connection arms in order to improve the moisture seal provided by said strip.

14. A heating element as defined in claim 1 further comprising connecting means for directly connecting said connection strips to at least one exterior electric unit.

15. A heating element as defined in claim 14 wherein said connection means extend through said connection strips.

16. A heating element as defined in claim 15 wherein said connection means are constituted by screws.

17. A heating element as defined in claim 1 further comprising connection means for directly connecting said connection strips to at least one exterior electric unit, said connection means comprising at least two connecting lugs each extending through a respective one of said connection strips and through said sheets of electrically insulating material and mechanically secured to said connection strips.

18. In an electric household appliance for generating heat, the improvement comprising a heating element as defined in claim 1.

19. In an electric household pressing iron, the improvement comprising a heating element as defined in claim 1.

20. A flexible heating element comprising:

a resistive conductor circuit which includes at least one resistive conductor composed of resistive material and having a first pair of ends such that the resistive material extends continuously between the ends;

two sheets of electrically insulating material enclosing said conductor;

and means for connecting said conductor to at least one exterior electric unit, wherein said means for connecting are constituted by at least one flexible connection tongue forming a projecting portion of said heating element, and composed of portions of said sheets of electrically insulating material, and two connection strips disposed in said flexible connection tongue for connection to the electric unit, and wherein said connection strips are each conductively connected to a respective end of said first pair of ends and are dimensioned to have a resistance appropriate to their connection function, and said portions of said sheets of electrically insulating material surround said connection strips and extend between said connection strips.

21. A flexible heating element as defined in claim 20 wherein said connection strips are made of the same resistive material as said one resistive conductor.

22. A flexible heating element as defined in claim 21 wherein said connection strips are integral with, and form projecting portions of, said ends of said one resistive conductor.

* * * * *